US009958133B2

(12) United States Patent
Hirai et al.

(10) Patent No.: US 9,958,133 B2
(45) Date of Patent: May 1, 2018

(54) OPTICAL LENS, LENS ARRAY, AND LIGHTING APPARATUS

(71) Applicant: Panasonic Intellectual Property Management Co., Ltd., Osaka-shi, Osaka (JP)

(72) Inventors: Jun Hirai, Nara (JP); Tadashi Murakami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 98 days.

(21) Appl. No.: 15/214,794

(22) Filed: Jul. 20, 2016

(65) Prior Publication Data

US 2017/0030548 A1 Feb. 2, 2017

(30) Foreign Application Priority Data

Jul. 28, 2015 (JP) ..... 2015-149054

(51) Int. Cl.
*F21V 5/00* (2015.01)
*F21K 9/64* (2016.01)
(Continued)

(52) U.S. Cl.
CPC ..... *F21V 5/007* (2013.01); *F21K 9/64* (2016.08); *F21V 5/04* (2013.01); *F21V 5/08* (2013.01);
(Continued)

(58) Field of Classification Search
CPC ..... F21V 13/04; F21V 5/08; F21V 9/0091; F21S 8/0086
See application file for complete search history.

(56) References Cited

U.S. PATENT DOCUMENTS 8,764,232 B2 * 7/2014 Wilcox ..... F21V 5/04 362/245
2010/0027271 A1 * 2/2010 Wilcox ..... F21S 8/081 362/311.02
(Continued)

FOREIGN PATENT DOCUMENTS

JP 2013-093200 A 5/2013
JP 2014-072108 A 4/2014
(Continued)

*Primary Examiner* — Elmito Breval
*Assistant Examiner* — Michael Chiang
(74) *Attorney, Agent, or Firm* — McDermott Will & Emery LLP

(57) ABSTRACT

An optical lens includes: a first lens surface which defines a space for housing a light emitting diode (LED) light source; a second lens surface formed in a convex shape; and a third lens surface formed continuously from a rear edge portion of the second lens surface, which is on a side opposite an illumination target side. The first lens surface includes a first light-entering surface through which a portion of light from the LED light source enters, and a second light-entering surface through which another portion of the light enters. The third lens surface totally reflects, to a substrate, at least a portion of the light. An angle between the third lens surface and a principal surface of the substrate on a virtual plane which includes an optical axis is smaller than an angle between the second light-entering surface and the principal surface on the virtual plane.

8 Claims, 8 Drawing Sheets

(51) Int. Cl.

| | |
|---|---|
| ***F21V 5/04*** | (2006.01) |
| ***F21V 5/08*** | (2006.01) |
| *F21V 7/00* | (2006.01) |
| *F21Y 115/10* | (2016.01) |
| *F21W 131/103* | (2006.01) |
| *F21Y 105/10* | (2016.01) |
| *F21S 2/00* | (2016.01) |
| *F21S 8/08* | (2006.01) |
| *F21Y 105/16* | (2016.01) |

(52) U.S. Cl.
CPC ..... *F21S 2/00* (2013.01); *F21S 8/086* (2013.01); *F21V 7/0091* (2013.01); *F21W 2131/103* (2013.01); *F21Y 2105/10* (2016.08); *F21Y 2105/16* (2016.08); *F21Y 2115/10* (2016.08)

(56) References Cited

U.S. PATENT DOCUMENTS

2012/0307495 A1* 12/2012 Shih ..... G02B 19/0066 362/237
2014/0016326 A1* 1/2014 Dieker ..... F21V 13/04 362/308
2014/0286018 A1* 9/2014 Zhang ..... G02B 19/0047 362/311.02
2016/0161084 A1* 6/2016 Cho ..... F21V 5/08 362/235

FOREIGN PATENT DOCUMENTS

JP 2014-078385 A 5/2014
JP 2014-093233 A 5/2014
JP 2014-191336 A 10/2014

* cited by examiner

OPTICAL LENS, LENS ARRAY, AND LIGHTING APPARATUS

CROSS REFERENCE TO RELATED APPLICATION

This application claims the benefit of priority of Japanese Patent Application Number 2015-149054 filed on Jul. 28, 2015, the entire content of which is hereby incorporated by reference.

BACKGROUND

1. Technical Field

The present disclosure relates to an optical lens, a lens array, and a lighting apparatus.

2. Description of the Related Art

For example, lighting apparatuses disposed outside, such as road lights, street lights, tunnel lights, and parking lot lights, are often installed on lighting poles, for instance. The place where a lighting pole is installed is at a location where the pole does not block the paths of persons, vehicles, and so on. For example, if a lighting pole is installed on the roadside, an illumination target that is to be illuminated by a lighting apparatus is at a location shifted forward (toward the road) from the place where the lighting apparatus is installed. If a lighting apparatus emits light rearward of the lighting apparatus, this causes glare, for example. Thus, there is a demand for preventing a lighting apparatus from emitting light rearward of the lighting apparatus. To meet this demand, Japanese Unexamined Patent Application Publication No. 2014-191336 (Patent Literature 1) discloses a technique of controlling distribution of light from a lighting apparatus, using, for example, an optical lens which covers a light emitting diode (LED) light source.

SUMMARY

The optical lens mentioned above reduces light which illuminates the rear of the lighting apparatus, yet this light distribution control still allows rearward light emission through the optical lens (K4 and K5 in FIG. 6 of Patent Literature 1). Light emitted through the optical lens may be reflected off another member, and consequently illuminate the rear of the lighting apparatus.

In view of the above, the present disclosure provides an optical lens which reduces light emitted through an optical lens in an undesired direction.

The optical lens according to an aspect of the present disclosure is an optical lens which is to be disposed on an optical axis of a light emitting diode (LED) light source disposed on a substrate, and diffuses light from the LED light source toward an illumination target at a location away from the optical axis, the optical lens including: a first lens surface having a concave shape which defines a space for housing the LED light source; a second lens surface formed in a convex shape curving outward at a position opposite the first lens surface; and a third lens surface formed continuously from a rear edge portion of the second lens surface, the rear edge portion being on a side opposite an illumination target side, wherein: the first lens surface includes a first light-entering surface through which a portion of the light from the LED light source enters, and a second light-entering surface through which another portion of the light from the LED light source enters, the second lens surface is a light-exiting surface which refracts at least a portion of the light which has entered the optical lens through the first light-entering surface, in a direction with a predetermined tilt relative to the optical axis, thereby causing the portion of the light to travel to the illumination target, the third lens surface is a total reflection surface which totally reflects, to the substrate, at least a portion of the light which has entered the optical lens through the second light-entering surface, and an angle between the third lens surface and a principal surface of the substrate on a virtual plane which includes the optical axis is smaller than an angle between the second light-entering surface and the principal surface of the substrate on the virtual plane, at any rotated position, when the virtual plane is rotated about the optical axis to cut the third lens surface.

A lens array according to another aspect of the present disclosure includes a plurality of optical lenses arranged in an array, each of the plurality of optical lenses being the optical lens.

A lighting apparatus according to another aspect of the present disclosure includes: a light emitting diode (LED) light source disposed on a substrate; and an optical lens which is to be disposed on an optical axis of the LED light source, and diffuses light from the LED light source toward an illumination target at a location away from the optical axis, the optical lens including: a first lens surface having a concave shape which defines a space for housing the LED light source; a second lens surface formed in a convex shape curving outward at a position opposite the first lens surface; and a third lens surface formed continuously from a rear edge portion of the second lens surface, the rear edge portion being on a side opposite an illumination, target side, wherein: the first lens surface includes a first light-entering surface through which a portion of the light from the LED light source enters, and a second light-entering surface through which another portion of the light from the LED light source enters, the second lens surface is a light-exiting surface which refracts at least a portion of the light which has entered the optical lens through the first light entering surface, in a direction with a predetermined tilt relative to the optical axis, thereby causing the portion of the light to travel to the illumination target, the third lens surface is a total reflection surface which totally reflects, to the substrate, at least a portion of the light which has entered the optical lens through the second light-entering surface, and an angle between the third lens surface and a principal surface of the substrate on a virtual plane which includes the optical axis is smaller than an angle between the second light-entering surface and the principal surface of the substrate on the virtual plane, at any rotated position, when the virtual plane is rotated about the optical axis to cut the third lens surface.

According to the present disclosure, light emitted through an optical lens in an undesired direction can be reduced.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Embodiment 1

The following specifically describes embodiments, with reference to the drawings. The embodiments described below each show a general or specific example. The numerical values, shapes, materials, elements, the arrangement and connection of the elements, and others indicated in the following embodiments are mere examples, and thus are not intended to limit the present disclosure. Therefore, among the elements in the following embodiments, elements not recited in any of the independent claims defining the most generic part of the inventive concept are described as arbitrary elements. In addition, the drawings are schematic diagrams, and do not necessarily provide strictly accurate illustration.

[Entire Configuration]

The following describes alighting apparatus according to Embodiment 1.

Figure 1:
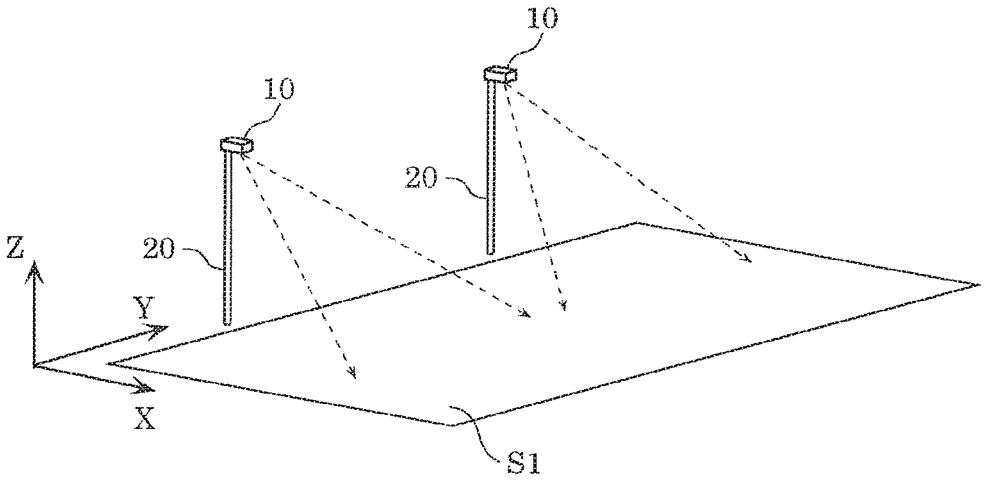
FIG. 1 is a perspective view illustrating schematic structures of lighting apparatuses according to Embodiment 1.

FIG. 1 is a perspective view illustrating schematic structures of the lighting apparatuses according to Embodiment 1.

As illustrated in FIG. 1, lighting apparatus 10 is supported at an upper portion of support 20 such as a lighting pole, for example. Lighting apparatuses 10 illuminate illumination targets S1 such as roads, streets, and parking lots. Accordingly, support 20 is installed at a location where support 20 does not become an obstacle to illumination target S1. For example, if lighting apparatus 10 illuminates a road or a street, support 20 is installed at the roadside such as a gore area or on the side of the street. Thus, lighting apparatus 10 illuminates illumination target S1 which is not directly under lighting apparatus 10, but away from the position directly under lighting apparatus 10.

In the present embodiment, the direction from lighting apparatus 10 to illumination target S1 (the positive direction of the X axis) on a horizontal plane is referred to as "forward", whereas the direction from illumination target S1 to lighting apparatus 10 (the negative direction of the X axis) on a horizontal plane is referred to as "rearward".

Figure 2:
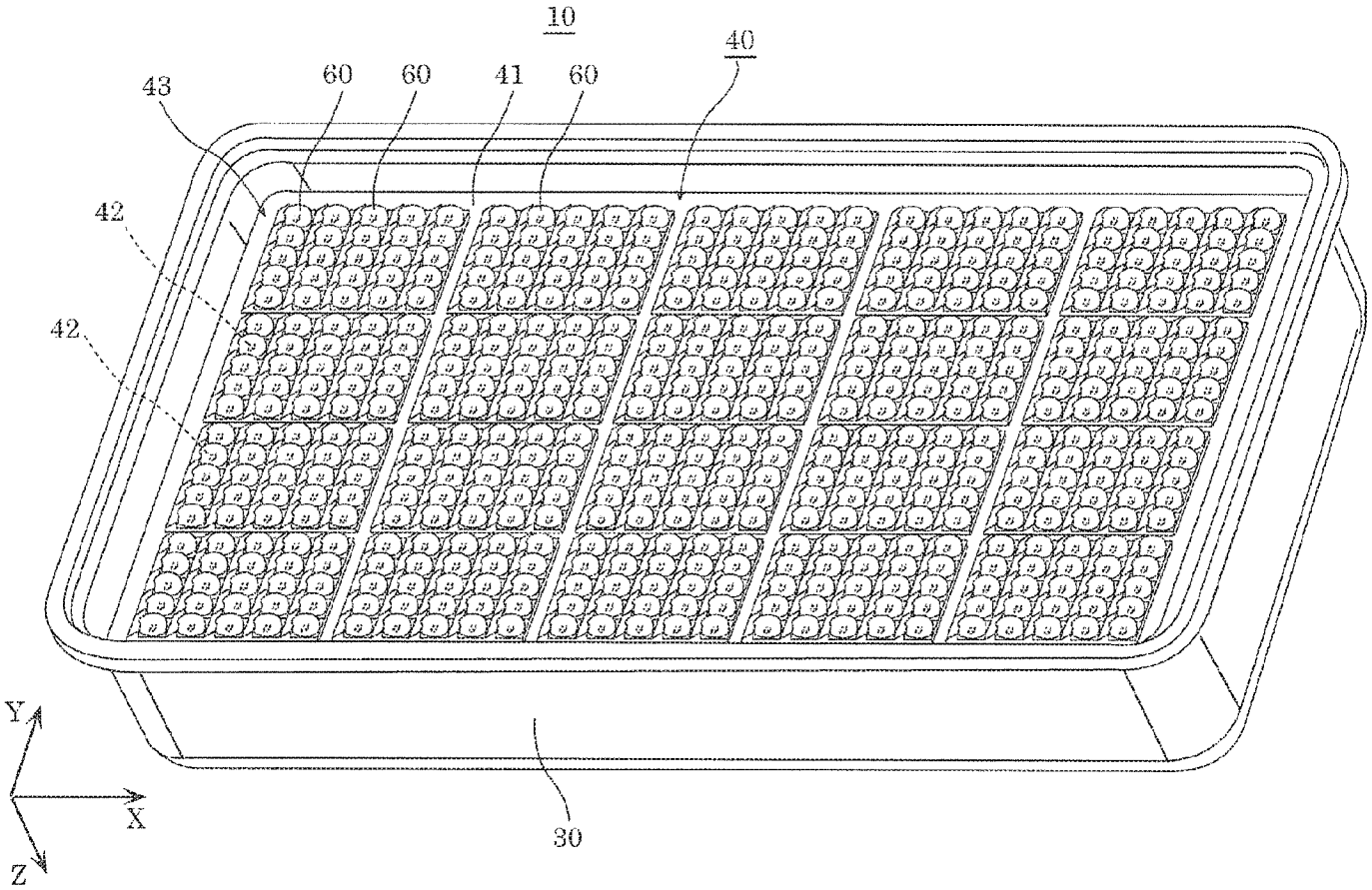
FIG. 2 is a perspective view illustrating a schematic structure of the lighting apparatus according to Embodiment 1.

FIG. 2 is a perspective view illustrating a schematic structure of lighting apparatus 10 according to the present embodiment. FIG. 2 illustrates lighting apparatus 10 from below.

Lighting apparatus 10 includes casing 30, lighting apparatus 40, and a power unit which is not illustrated.

Casing 30 is fixed to support 20 while housing lighting apparatus 40. Casing 30 is formed into a rectangular box-like shape whose one side is open, and houses lighting device 40 and the power unit inside of casing 30.

Lighting device 40 includes substrate 41, light emitting diode (LED) light sources 42, and lens array 43.

Substrate 41 is a substrate which has a substantially rectangular shape and on which LED light sources 42 and lens array 43 are mounted, and is disposed on a top surface of casing 30. LED light sources 42 are disposed in a two-dimensional array on substrate 41. Lens array 43 is fixed to substrate 41 so as to cover LED light sources 42 on substrate 41. The power unit is disposed on the back side of substrate 41. The power unit includes a power circuit, such as an AC-DC converter which converts an alternating voltage from an external AC power supply into a predetermined direct voltage, and outputs the resultant voltage to LED light sources 42.

LED light source 42 includes a white LED which includes an LED chip and a wavelength converter.

An LED chip whose size is, for instance, 0.3 $mm^2$ (0.3 mm×0.3 mm), 0.45 $mm^2$ (0.45 mm×0.45 mm), or 1 $mm^2$ (1 mm×1 mm) can be used. The planar shape of the LED chip is not limited to a square shape, but may be a rectangular shape, for example. If the LED chip has a rectangular planar shape, an LED chip whose size is, for example, 0.5 mm×0.24 mm may be used.

The LED chip may be, for example, a blue LED chip which emits blue light. For example, a gallium nitride based blue LED chip can be employed as a blue LED chip. An LED chip is not limited to a blue LED chip, and for example, a purple LED chip which emits purple light or an ultraviolet LED chip which emits ultraviolet light can be employed.

The wavelength converter of LED light source 42 has a layered shape. The shape of the wavelength converter is not limited to the layered shape, and examples of the shape which can be employed include a hemispherical shape, an oval hemispherical shape, a domed shape, a rectangular parallelepiped shape, and a plate-like shape. The wavelength converter may also serve as a sealing part which seals the LED chip. The wavelength converter may be formed of a mixture of a light transmissive material which transmits visible light and a wavelength conversion material, and covering the LED chip.

Although a silicon resin, is used as the light transmissive material, the light transmissive material is not limited to a silicon resin. For example, an epoxy resin, an acrylic resin, glass, or an organic-inorganic hybrid material may also be used.

The wavelength conversion material may include a yellow phosphor. Examples of a yellow phosphor which may be employed include $Ce^{3+}$-activated yttrium aluminum garnet (YAG) phosphor and $Eu^{2+}$-activated oxynitride phosphor. An example of a $Ce^{3+}$-activated YAG phosphor is, for instance, $Y_3Al_5O_{12}:Ce^{3+}$. An example of a $Eu^{2+}$-activated oxynitride phosphor is $SrSi_2O_2N_2:Eu^{2+}$, for instance.

The wavelength conversion material may further include, for example, a red phosphor, in addition to a yellow phosphor. In short, the wavelength conversion material may include a yellow phosphor and a red phosphor. As the red phosphor, a $Eu^{2+}$-activated nitride phosphor can be employed, for example. Examples of a $Eu^{2+}$-activated nitride phosphor include $(Sr,Ca)AlSiN_3:Eu^{2+}$ and $CaAlSiN_3:Eu^{2+}$.

If an LED chip is an ultraviolet LED chip or a purple LED chip, LED light source 42 may be achieved such that the wavelength conversion material includes a blue phosphor, a green phosphor, and a red phosphor, for example.

LED light source 42 is configured to emit white light as color mixed light which is a mixture of light radiated from the LED chip and emitted from the wavelength converter without being subjected to wavelength conversion by the wavelength converter, and light radiated from the LED chip and emitted from the wavelength converter after having been subjected to wavelength conversion by the wavelength converter.

The following describes lens array 43.

Figure 3:
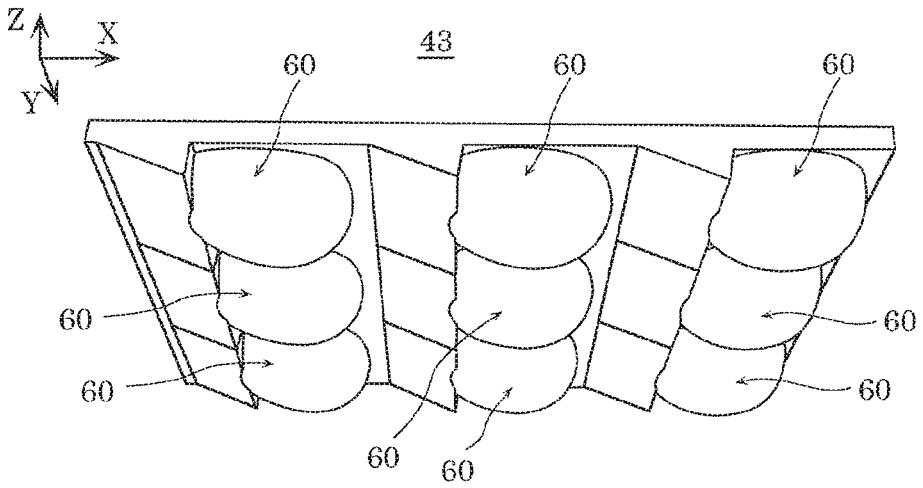
FIG. 3 is a perspective view illustrating a schematic structure of a lens array according to Embodiment 1.

FIG. 3 is a perspective view illustrating a schematic structure of lens array 43 according to the present embodiment, and is a perspective view of lens array 43 from below (the negative side of the Z axis). FIG. 3 illustrates a portion of lens array 43, or specifically, only a portion corresponding to, among all LED light sources 42, nine LED light sources 42 disposed in three rows and three columns. Accordingly, actual lens array 43 has a shape and size corresponding to all LED light sources 42.

Lens array 43 is an optical member which diffuses light emitted from LED light sources 42 toward illumination target S1. As illustrated in FIG. 3, lens array 43 integrally includes optical lenses 60 in same number as LED light sources 42 so as to be in one-to-one correspondence with LED light sources 42. In other words, FIG. 3 illustrates nine optical lenses 60 corresponding to nine LED light sources 42.

Lens array 43 is formed of a light transmissive material. A light transmissive material is a material, that transmits light in the spectrum of light emitted by LED tight source 42. Examples of the light transmissive material include an acrylic resin, a polycarbonate resin, a silicon resin, and glass.

The following describes optical lens 60.

Figure 4:
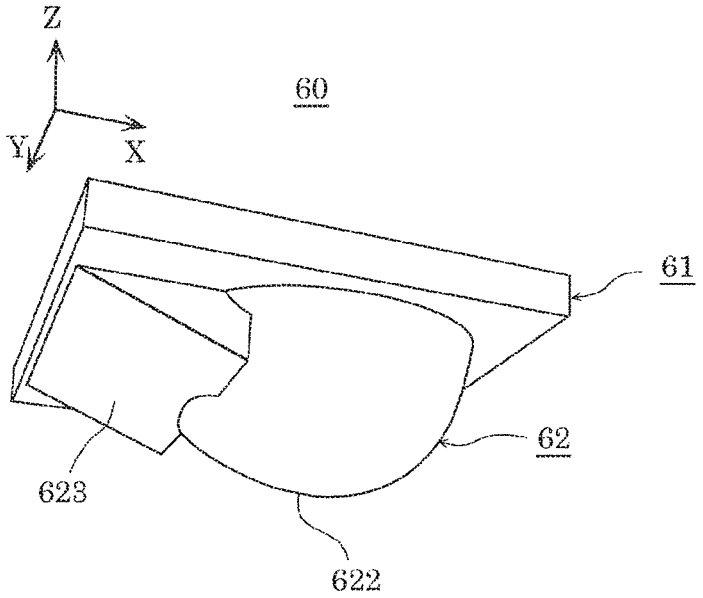
FIG. 4 is a perspective view illustrating a schematic structure of an optical lens according to Embodiment 1.
Figure 5:
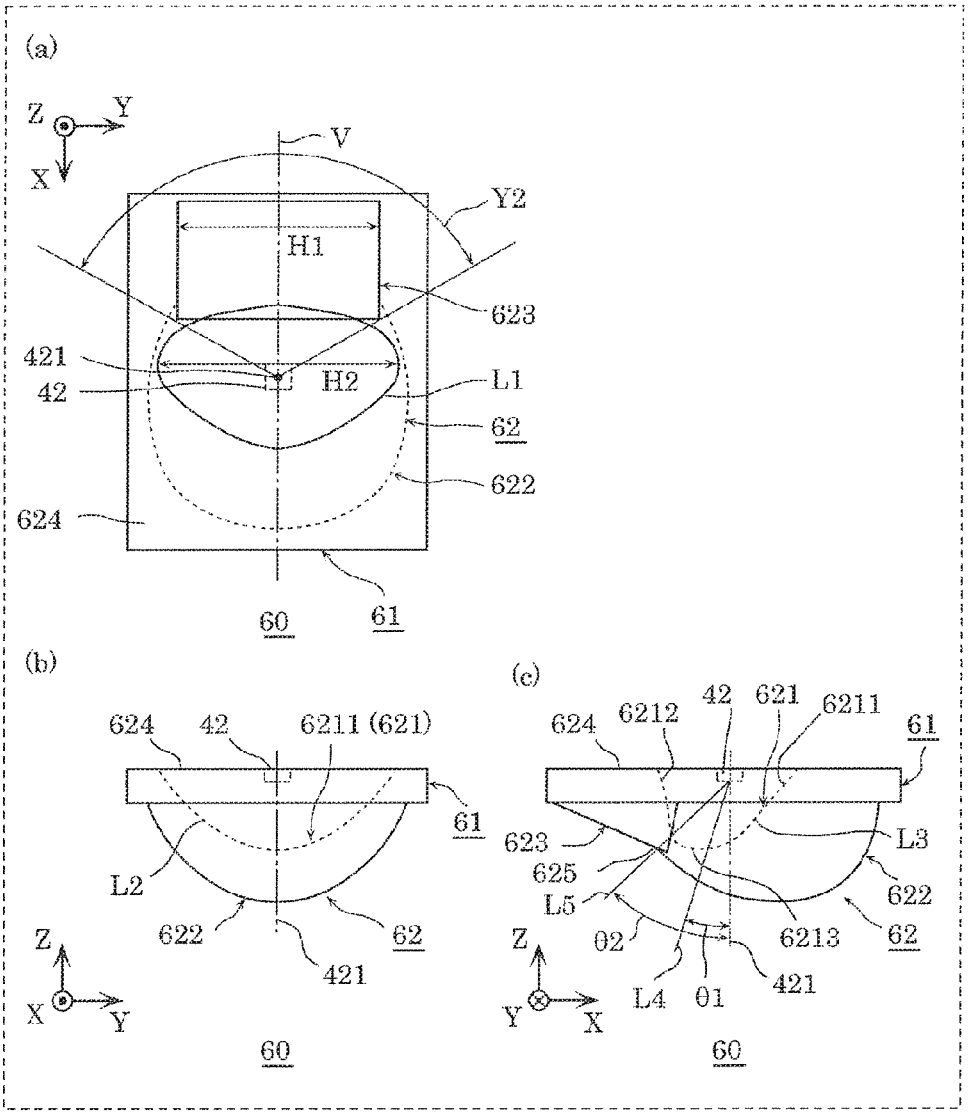
FIG. 5 is an explanatory diagram illustrating the schematic structure of the optical lens according to Embodiment 1, where (a) of FIG. 5 is a top view, (b) of FIG. 5 is a front view, and (c) of FIG. 5 is a side view.

FIG. 4 is a perspective view illustrating a schematic structure of optical lens 60 according to the present embodiment, and is a perspective view of optical lens 60 from below (the negative side of the Z axis). FIG. 5 is an explanatory diagram illustrating the schematic structure of optical lens 60 according to the present embodiment, where (a) of FIG. 5 is a top view, (b) of FIG. 5 is a front view, and (c) of FIG. 5 is a side view.

As illustrated in FIGS. 4 and 5, optical lens 60 includes flange 61 and lens body 62 which are integrally formed.

Flange 61 is a portion connected to flange 61 of adjacent optical lens 60. Flange 61 has a predetermined thickness, and is extending from the periphery of lens body 62 in the horizontal direction (along the XY plane). The external shape of flange 61 is rectangular in top view as illustrated in (a) of FIG. 5, which shows the assumed case where one optical lens 60 is taken out from lens array 43. In practice, if there is adjacent lens body 62, flange 61 is connected to flange 61 of adjacent lens body 62. On the other hand, if there is no lens body 62 adjacent to flange 61, in other words, if flange 61 is at an edge of lens array 43, flange 61 has a shape corresponding to the edge shape of lens array 43.

Lens body 62 includes first lens surface 621, second lens surface 622, and third lens surface 623. The overall shape of lens body 62 is plane symmetry about the ZX plane (virtual plane V) which includes optical axis 421 of LED light source 42.

First lens surface 621 is a light entering surface recessed in a surface (upper surface 624) of lens body 62 facing substrate 41. LED light source 42 mounted on substrate 41 is housed in the space defined by first lens surface 621. First lens surface 621 is formed such that the size of first lens surface 621 on the XY plane is the greatest at a portion closest to substrate 41, and gradually decreases with an increase in the distance :from substrate 41. As shown by solid line L1 in (a) of FIG. 5, the shape of first lens surface 621 on upper surface 624 of lens body 62, namely, the shape of the opening formed by first lens surface 621 is substantially elliptical.

As shown by dashed line L2 in (b) of FIG. 5, the shape of first lens surface 621 viewed from front has a smooth concave shape whose vertex is at a portion corresponding to optical axis 421 of LED light source 42. As shown by dashed line L3 in (c) of FIG. 5, the shape of first lens surface 621 laterally viewed is a concave shape having a steep gradient on the rear side (the negative side of the X axis) and a gentle gradient on the front side (the positive side of the X axis). The vertex of dashed line L3 is at a position shifted rearward from optical axis 421.

Solid line L1 and dashed lines L2 and L3 in (a) to (c) of FIG. 5 show the outermost contours of first lens surface 621 as the drawings are viewed. A smooth curved surface which includes these outermost contours (solid line L1 and dashed lines L2 and L3) is first lens surface 621.

Here, first lens surface 621 has first light-entering surface 6211 and second light-entering surface 6212.

First light-entering surface 6211 is a light-entering surface through which a portion of light from LED light source 42 enters. First light-entering surface 6211 has a shape which guides, to second lens surface 622, at least a portion of light which has entered through first light-entering surface 6211. Note that first light-entering surface 6211 may be formed into a shape which can guide, to second lens surface 622, as much as possible of light which has entered through first light-entering surface 6211.

As illustrated in (c) of FIG. 5, first light-entering surface 6211 includes, within first lens surface 621, a forward area relative to optical axis 421, and an area up to tilted line L4 that is tilted rearward about LED light source 42 by angle θ1 relative to optical axis 421. In at least these areas, first light-entering surface 6211 guides light emitted from LED light source 42 to second lens surface 622.

Second light-entering surface 6212 is a light-entering surface through which another portion of light from LED light source 42 enters. Second light-entering surface 6212 has a shape which guides, to third lens surface 623, at least a portion of light which has entered through second light-entering surface 6212. Note that second light-entering surface 6212 may be formed into a shape which can guide, to third lens surface 623, as much as possible of light which has entered through second. light-entering surface 6212.

Second light-entering surface 6212 includes, within first lens surface 621, an area extending rearward from tilted line L5 that is tilted rearward about LED light source 42 relative to optical axis 421 by angle θ2 greater than angle θ1. In at least the area, second light-entering surface 6212 guides, to third lens surface 623, light emitted from LED light source 42.

Here, angle θ1 may be approximately 20 degrees, and angle θ2 may be approximately 45 degrees.

In the present embodiment, first lens surface 621 includes third light-entering surface 6213 between first light-entering surface 6211 and second light-entering surface 6212. Third light-entering surface 6213 has a shape which guides, to second lens surface 622, at least a portion of light which has entered through third light-entering surface 6213.

Second lens surface 622 is formed into a convex shape curving outward at a position opposite first lens surface 621. Second lens surface 622 is a light-exiting surface which refracts at least a portion of light which has entered through first light-entering surface 6211 in a direction with a predetermined tilt relative to optical axis 421, and causes the refracted light to travel to illumination target S1. Specifically, second lens surface 622 is formed into a curved shape which refracts at least a portion of light guided by first light-entering surface 6211, and causes the refracted light to travel forward, that is, to illumination target S1. Note that second lens surface 622 may be formed into a curved shape which can refract as much as possible of light guided by first light-entering surface 6211 and causes the refracted light to travel to illumination target S1.

Light which has entered through third light-entering surface 6213 of first lens surface 621 exits through second lens surface 622. Accordingly, second lens surface 622 may have a curved shape which refracts light guided by third light-entering surface 6213 as forward as possible.

Third lens surface 623 is a total reflection surface which totally reflects, to substrate 41, at least a portion of light which has entered through second light-entering surface 6212. Note that third lens surface 623 may be formed into a shape which can totally reflects, to substrate 41, as much as possible of light which has entered through second light-entering surface 6212.

Third lens surface 623 is continuously formed from a rear edge portion of second lens surface 622, that is, a rear edge portion of second lens surface 622 which is on a side opposite the illumination target S1 side. Portion 625 of a joint between third lens surface 623 and second lens surface 622 is located at or adjacent n intersection between tilted line L5 and second lens surface 622. Third lens surface 623 is a rectangular flat surface which is tilted rearward and gradually toward substrate 41. Third lens surface 623 is formed in an area between the rear edge portion of second lens surface 622 and a portion before reaching substrate 41. Third lens surface 623 is formed such that as illustrated in (a) of FIG. 5, width H1 (the length in the Y axis direction) of third lens surface 623 is smaller than maximum width H2 of first lens surface 621.

Figure 6:
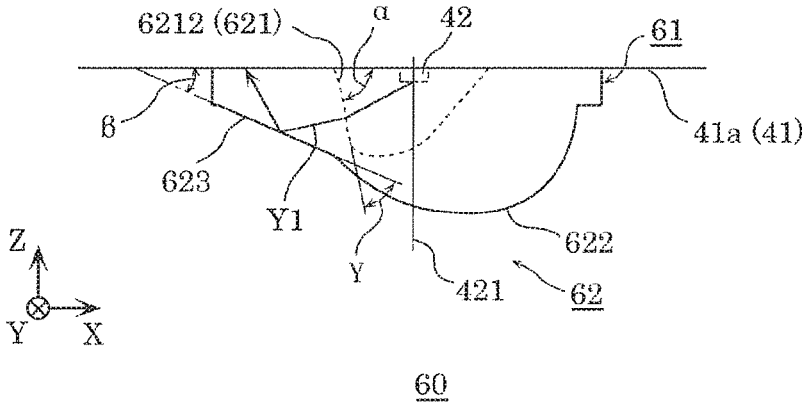
FIG. 6 is a cross-sectional view of the optical lens illustrating a relationship between a third lens surface and a second light-entering surface of a first lens surface, according to Embodiment 1.

FIG. 6 is a cross-sectional view of optical lens 60 illustrating a relationship between third lens surface 623 and second light-entering surface 6212 of first lens surface 621, according to the present embodiment. Note that FIG. 6 is a cross-sectional view taken along the ZX plane (virtual plane V) which includes optical axis 421 of LED light source 42. As illustrated in FIG, 6, angle β between third lens surface 623 and principal surface 41*a* of substrate 41 is smaller than angle α between second light-entering surface 6212 and principal surface 41*a* of substrate 41. Since this relationship is satisfied, light which has entered through second light-entering surface 6212 and been guided to third lens surface 623 is totally reflected by third lens surface 623 and travels to substrate 41 (arrow Y1 in FIG. 6).

Here, in order to further increase the reflectance at third lens surface 623, an angle at which light enters through third lens surface 623, in other words, an angle between a normal line to third lens surface 623 and light incident on third lens surface 623 may be equal to or greater than a critical angle at which light is totally reflected at the interface between a lens material. and air. Specifically, light emitted from LED light source 42 substantially perpendicularly enters through second light-entering surface 6212, this relationship can be achieved with ease by making angle γ between second light-entering surface 6212 and third lens surface 628 greater than or equal to the critical angle. In practice, this relationship may not be satisfied depending on a curvature of second light-entering surface 6212 and the position of LED light source 42, but gives one indication for increasing reflectance.

Although angle γ is adjusted according to the material of optical lens 60, angle γ may be in a range from 42 degrees to 90 degrees, both inclusive if light is emitted in the air. For example, if the material of optical lens 60 is an acrylic resin, angle γ may be set to the critical angle between the acrylic resin and air (approximately 42 degrees). Note that even if angle γ is smaller than the critical angle of the material of optical lens 60, light is totally reflected at third lens surface 623, and thus optical lens 60 may be formed such that angle γ is smaller than the critical angle of the material, taking into consideration how readily optical lens 60 is manufactured.

Note that second light-entering surface 6212 may be a flat surface if the above-mentioned relationship is to be satisfied by the entirety of second light-entering surface 6212. Furthermore, if second light-entering surface 6212 is a curved surface, angles α and γ may be determined based on a flat surface approximating the curved surface.

The above-mentioned relationship between angles α and β is satisfied on virtual plane V at any angle when virtual plane V is rotated about optical axis 421. The range of rotating virtual plane V is indicated by arrow Y2 illustrated in (a) of FIG. 5. This range corresponds to third lens surface 623. Thus, if the above-mentioned relationship between angles α and β is satisfied, third lens surface 623 may partially include a fiat surface or may be a curved surface, rather than a flat surface.

Appropriate shapes that satisfy the above conditions are selected for first, lens surface 621, second lens surface 622, and third lens surface 623, through, for instance, various simulations and experiments. Thus, first lens surface 621, second lens surface 622, and third lens surface 623 may each have any shape that satisfies the conditions described above.

The following describes operation of lighting device 10 according to the present embodiment.

If LED light source 42 emits light, light emitted from LED light source 42 enters optical lens 60 through first lens surface 621.

Here, among light emitted from LED light source 42, at least a portion of light which has entered through first light-entering surface 6211 and third light-entering surface 6213 of first lens surface 621 is guided, to second lens surface 622, by first light-entering surface 6211 and third light-entering surface 6213, and exits through second lens surface 622. This light passes through second lens surface 622 and thus is refracted forward, that is, to illumination target S1. Note that a portion of light guided by third light-entering surface 6213 to second lens surface 622 may not be refracted to illumination target S1.

On the other hand, among light emitted. from LED light source 42, at least a portion of light which has entered through second light-entering surface 6212 of first lens surface 621 is guided by second light-entering surface 6212 to third lens surface 623, and is totally reflected at third lens surface 623 to substrate 41. This prevents rearward light emission through optical lens 60. Note that although it is possible to assume that light which has reached substrate 41 is reflected at principal surface 41*a* of substrate 41 to the rear of optical lens 60, the amount of the reflected light is quite less than the amount of light directly emitted through optical lens 60. In order to prevent such a slight amount of rearward light emission, an area on substrate 41 in which light reflected off third lens surface 623 falls may be covered with an optically absorptive member or may be colored using an optically absorptive color, for example.

Figure 7:
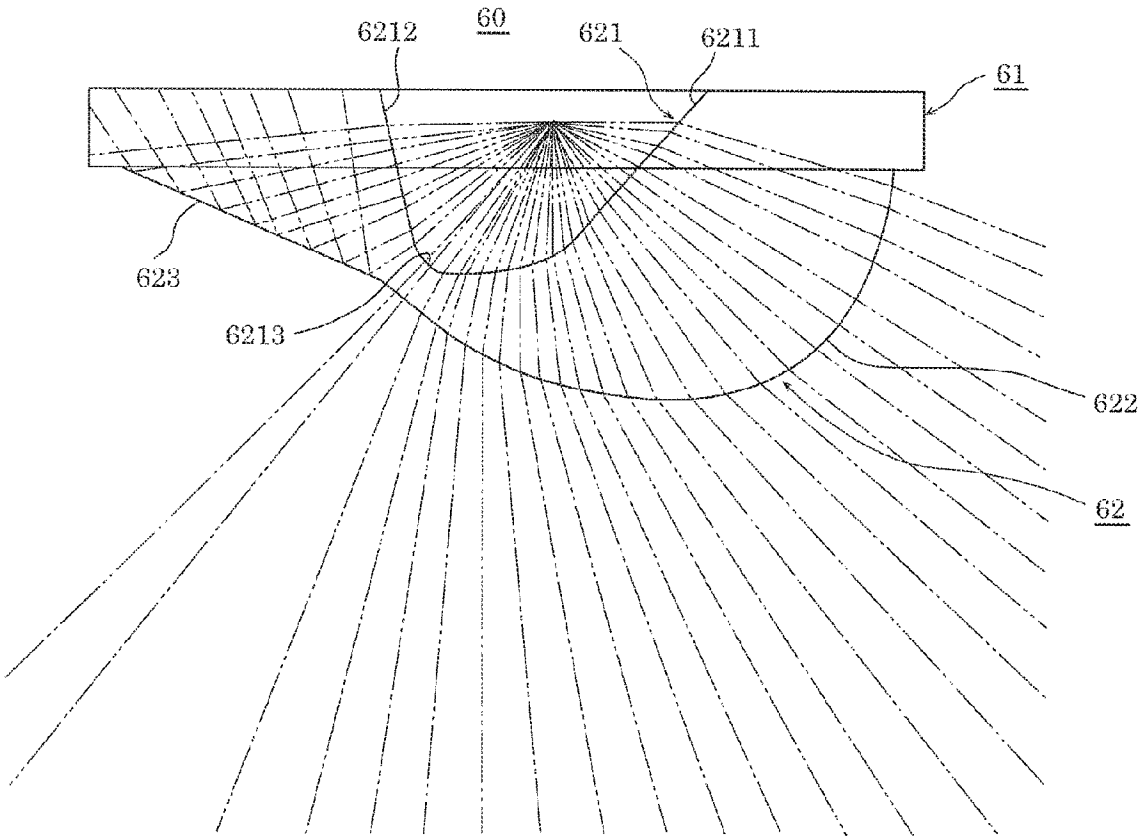
FIG. 7 illustrates rays of light which have passed though the optical lens according to Embodiment 1.

FIG. 7 illustrates rays of light which have passed through optical lens 60 according to the present embodiment. In FIG. 7, two-dot chain lines show paths of the rays. As illustrated in FIG. 7, most of the light which has exited through second lens surface 622 is refracted to illumination target S1. FIG. 7 also illustrates that most of the light which has entered through second light-entering surface 6212 is totally reflected at third lens surface 623 to substrate 41.

Figure 8:
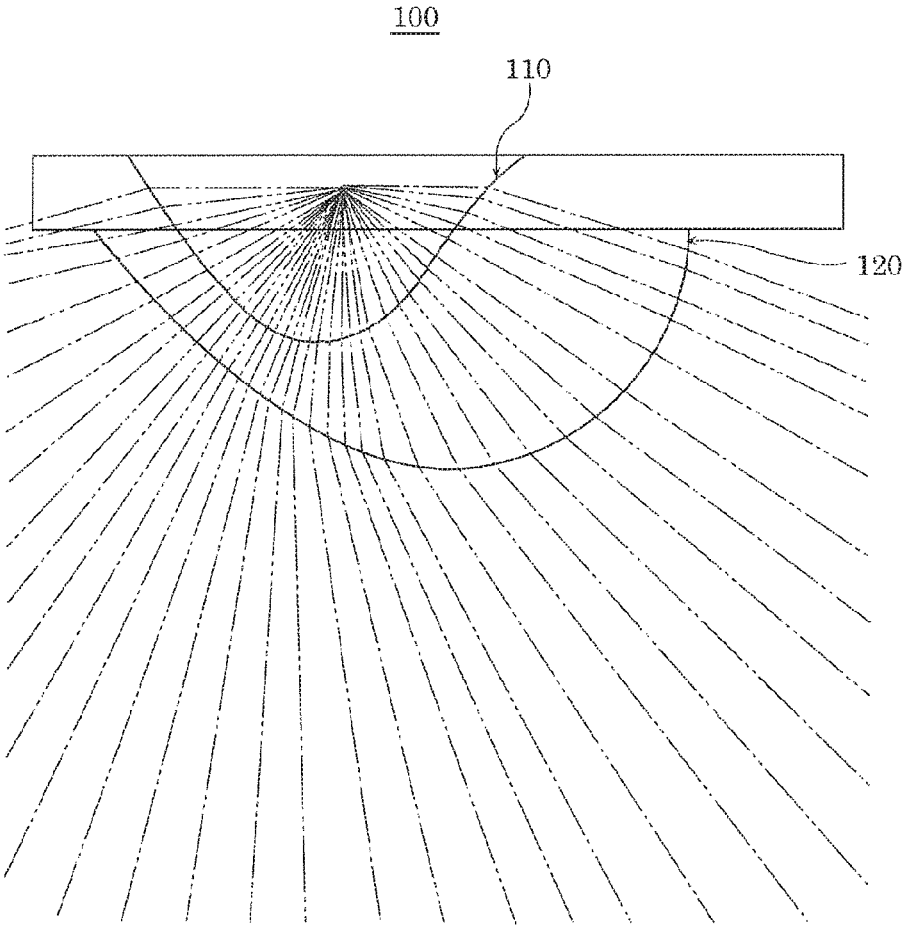
FIG. 8 illustrates rays of light which have passed through an optical lens which does not have the third lens surface.

FIG. 8 illustrates rays of light which have passed through an optical lens without the third lens surface. Also in FIG. 8, two-dot chain lines show paths of the rays. As illustrated in FIG. 8, optical lens 100 is different from optical lens 60 according to the present embodiment in that the shape of first lens surface 110 is different from the shape of first lens surface 621 in addition to the third lens surface not being included. First lens surface 110 of optical lens 100 is a concave surface. Second lens surface 120 is a convex surface curving outward so as to be opposite first lens surface 110. It can be seen that light exiting through second lens surface 120 nearly evenly and radially travels.

A comparison between FIGS. 7 and 8 shows that the amount of light emitted rearward is significantly reduced.

As described above, according to the present embodiment, second lens surface 622 refracts light which has entered through first light-entering surface 6211 of optical lens 60 in a direction with a predetermined tilt relative to optical axis 421, and causes the refracted light to travel to illumination target S1. This allows a greater amount of light to be emitted through optical lens 60 in a desired direction (forward in the present embodiment).

On virtual plane V, angle β between third lens surface 623 and principal surface 41*a* of substrate 41 is smaller than angle α between second light-entering surface 6212 and principal surface 41*a* of substrate 41. This allows light which has entered through second light-entering surface 6212 to be totally reflected at third lens surface 623 to substrate 41. Thus, light emitted through optical lens 60 in an undesired direction (rearward in the present embodiment) can be reduced.

Furthermore, angle γ between second light-entering surface 6212 and third lens surface 623 is within a range between 42 degrees and 90 degrees, both inclusive. Thus, even if optical lens 60 is formed using a typical resin material, light guided by second light-entering surface 6212 can be reliably totally reflected at third lens surface 623.

Third lens surface 623 is a flat surface, and thus can be readily formed compared to the case where third lens surface 623 is a curved surface.

Third lens surface 623 is formed in an area from a rear edge portion of second lens surface 622 to a portion before reaching substrate 41, and thus the total length of third lens surface 623 can be shortened, thus achieving a reduction in size of optical lens 60.

Embodiment 2

Embodiment 1 has described an example in which portion 625 of the joint between third lens surface 623 and second lens surface 622 is at or adjacent to an intersection between tilted line L5 and second lens surface 622. Embodiment 2 describes a case where a portion of a joint between a third lens surface and a second lens surface is at a different position from that of Embodiment 1.

Note that in the following description, the same portion as that in Embodiment 1 is given the same numeral, and a description thereof may be omitted.

Figure 9:
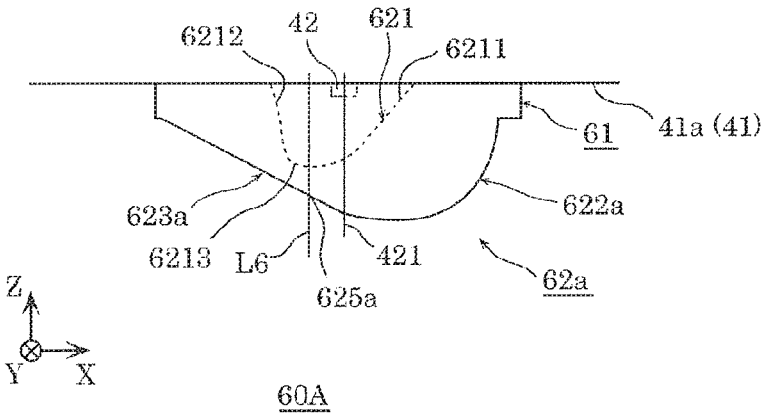
FIG. 9 is a cross-sectional view illustrating a schematic structure of an optical lens according to Embodiment 2.

FIG. 9 is a cross-sectional view illustrating a schematic structure of optical lens 60A according to Embodiment 2, and corresponds to FIG. 6.

As illustrated in FIG. 9, in optical lens 60A, portion 625*a* of a joint between second lens surface 622*a* and third lens surface 623*a* is at or adjacent to an intersection between second lens surface 622*a* and normal line L6 to substrate 41, which is passing through a vertex of first lens surface 621. Note that the entire joint between second lens surface 622*a* and third lens surface 623*a* may be along or adjacent to the YZ plane that includes normal line L6.

Here, a portion of first lens surface 621 on the rear side (negative side of the X axis) relative to the YZ plane that includes normal line L6 is within third lens surface 623*a* when viewed in the optical axis direction. The portion on the rear side includes not only second light-entering surface 6212, but also the entirety of third light-entering surface 6213 and a portion of first light-entering surface 6211. In other words, third lens surface 623*a* catches and totally reflects light which has entered through third light-entering surface 6213 and light which has entered through a portion of first light-entering surface 6211, in addition to the light which has entered through second light-entering surface 6212. Accordingly, a greater portion of light traveling rearward can be totally reflected at third lens surface 623*a*.

As described above, according to the present embodiment, portion 625*a* of the joint between second lens surface 622*a* and third lens surface 623*a* is at or adjacent to an intersection between second lens surface 622*a* and normal line L6 to substrate 41, which is passing through the vertex of first lens surface 621, and thus a greater portion of light traveling rearward can be totally reflected at third lens surface 623*a*. This can further reduce light emission through optical lens 60A in an undesired direction.

Normal line L6 is located rearward relative to optical axis 421 of light source 42, and thus a joint between second lens surface 622*a* and third lens surface 623*a* is also located rearward relative to optical axis 421. Accordingly, a great portion of light emitted from light source 42 enters through first light-entering surface 6211, and is refracted and diffused at second lens surface 622*a* to illumination target S1. Thus, the illuminance on illumination target S1 can be maintained.

Embodiment 3

Embodiment 2 has described an example in which portion 625*a* of the joint between third lens surface 623*a* and second lens surface 622*a* is at or adjacent to an intersection between second lens surface 622*a* and normal line L6 to substrate 41, which is passing through the vertex of first lens surface 621. Embodiment 3 describes the case where a portion of a joint between a third lens surface and a second lens surface is at a different position from those of Embodiments 1 and 2.

Note that in the following description, the same portion as that of Embodiments 1 and 2 is given the same numeral, and the description thereof may be omitted.

Figure 10:
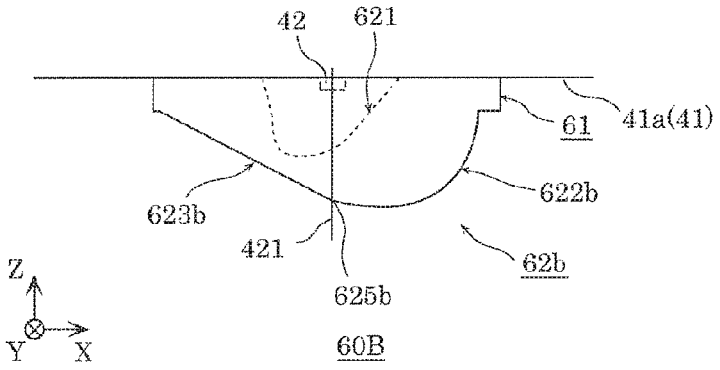
FIG. 10 is a cross-sectional view illustrating schematic structure of an optical lens according to Embodiment 3.

FIG. 10 is a cross-sectional view illustrating a schematic structure of optical lens 60B according to Embodiment 3, and corresponds to FIGS. 6 and 9.

As illustrated in FIG. 10, in optical lens 60B, portion 625*b* of a joint between second lens surface 622*b* and third lens surface 623*b* is at or adjacent to an intersection between optical axis 421 of LED light source 42 and second lens surface 622*b*. Note that the entire joint between second lens surface 622*b* and third lens surface 623*b* may be provided at or adjacent to the YZ plane which includes optical axis 421.

In other words, third lens surface 623*b* handles most of the light emitted rearward, among light emitted from LED light source 42 when viewed in the optical axis direction. Thus, even if light traveling rearward from LED light source 42 enters through first light-entering surface 6211 and third light-entering surface 6213, third lens surface 623*b* can catch and totally reflect the light. In this manner, third lens surface 623*b* can totally reflect a greater amount of light than optical lens 60A described in Embodiment 2.

As described above, according to the present embodiment, portion 625*b* of the joint between second lens surface 622*b* and third lens surface 623*b* is at or adjacent to an intersection between optical axis 421 and second lens surface 622*b*, and thus third lens surface 623*b* can totally reflect a greater amount of light. This can more reliably prevent light emission through optical lens 60B in an undesired direction.

Other Embodiments

Although the above has described a lighting device according to the embodiments, the present disclosure is not limited to the above embodiments. Note that in the following description, the same portion as that in Embodiments 1 and 2 above is given the same numeral, and a description thereof may be omitted.

For example, Embodiment 1 above has described an example in which lens array 43 having plural optical lenses 60 are integrally disposed. However, single optical lens 60 can be used. In this case, flange 61 of optical lens 60 is used to maintain the strength of optical lens 60 and to form an attachment portion for attaching optical lens 60 to a substrate or the body of a lighting device.

If single optical lens 60 is used, it is possible assume that light may leak rearward from flange 61.

Figure 11:
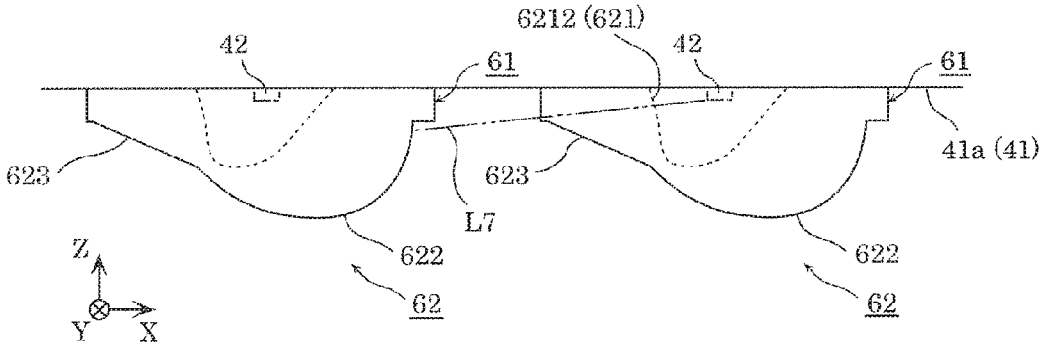
FIG. 11 is a cross-sectional view illustrating an example in which a plurality of separate optical lenses are arranged in a forward-rearward direction, according to a variation of the embodiments.

FIG. 11 is a cross-sectional view illustrating an example in which as a variation according to the embodiments, separate optical lenses 60 are arranged in the forward-rearward direction.

As illustrated in FIG. 11, even if light (indicated by two-dot chain line L7) leaks rearward from flange 61 of optical lens 60 disposed on the front side, the leaking light can be blocked by optical lens 60 disposed on the rear side. Note that light leaking rearward from flange 61 may be blocked by another member, other than optical lens 60, included in a lighting device, or a member dedicated for blocking light may be newly attached.

Note that light can be prevented from leaking rearward using only one optical lens.

Figure 12:
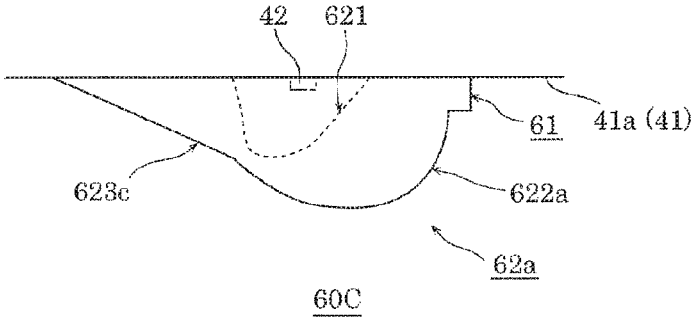
FIG. 12 is a cross-sectional view illustrating an optical lens according to a variation of the embodiments.

FIG. 12 is a cross-sectional view illustrating an optical lens according to a variation of the embodiments.

As illustrated in FIG. 12, in optical lens 60C, third lens surface 623*c* extends to a portion substantially reaching substrate 41. Consequently, a rear edge surface of flange 61 also serves as third lens surface 623*c*, and thus light which is to leak rearward from flange 61 can be totally reflected at third lens surface 623*c* to substrate 41.

Note that if third lens surface 623*c* extends beyond the light distribution angle of LED light source 42, third lens surface 623*c* prevents light from leaking rearward.

Embodiment 1 above has described an example in which width H1 of third lens surface 623 is smaller than maximum width H2 of first lens surface 621. However, width H1 of third lens surface 623 may be greater than maximum width H2 of first lens surface 621. In this manner, third lens surface 623 can be formed over a larger area, which further reduces light emission in an undesired direction.

Furthermore, width H1 of third lens surface 623 may be greater than maximum width H2 of first lens surface 621 and smaller than the maximum width of second lens surface 622. This increases third lens surface 623 as much as possible while preventing an increase in size of optical lens 60.

Furthermore, Embodiments 1 to 3 above and the above variations may be combined.

While the foregoing has described what are considered to be the best mode and/or other examples, it is understood, that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An optical lens which is to be disposed on an optical axis of a light emitting diode (LED) light source disposed on a substrate, and diffuses light from the LED light source toward an illumination target at a location away from the optical axis, the optical lens comprising:

a first lens surface having a concave shape which defines a space for housing the LED light source;

a second lens surface formed in a convex shape curving outward at a position opposite the first lens surface; and a third lens surface formed continuously from a rear edge portion of the second lens surface, the rear edge portion being on a side opposite an illumination target side, wherein:

the first lens surface includes a first light-entering surface through which a portion of the light from the LED light source enters, and a second light-entering surface through which another portion of the light from the LED light source enters, the second lens surface is a light-exiting surface which refracts at least a portion of the light which has entered the optical lens through the first light-entering surface, in a direction with a predetermined tilt relative to the optical axis, thereby causing the portion of the light to travel to the illumination target, the third lens surface is a total reflection surface which totally reflects, to the substrate, at least a portion of the light which has entered the optical lens through the second light-entering surface, and an angle between the third lens surface and a principal surface of the substrate on a virtual plane which includes the optical axis is smatter than an angle between the second light-entering surface and the principal surface of the substrate on the virtual plane, at any rotated position, when the virtual plane is rotated about the optical axis to cut the third lens surface.

2. The optical lens according to claim 1, wherein an angle between the second light-entering surface and the third lens surface is in a range between 42 degrees and 90 degrees, both inclusive.

3. The optical lens according to claim 1, wherein the third lens surface includes a flat surface.

4. The optical lens according to claim 1, wherein the third lens surface is formed in an area from the rear edge portion of the second lens surface to a portion that is adjacent to the substrate.

5. The optical lens according to claim 1, wherein a portion of a joint between the second lens surface and the third lens surface is at or adjacent to an intersection between the second lens surface and a normal line to the substrate, the normal line passing through a vertex of the first lens surface.

6. The optical lens according to claim 1, wherein a portion of a joint between the second lens surface and the third lens surface is at or adjacent to an intersection between the optical axis and the second lens surface.

7. A lens array comprising a plurality of optical lenses arranged in an array, each of the plurality of optical lenses being the optical lens according to claim 1.

8. A lighting apparatus comprising:

a light emitting diode (LED) light source disposed on a substrate; and an optical lens which is to be disposed on an optical axis of the LED light source, and diffuses light from the LED light source toward an illumination target at a location away from the optical axis, the optical lens including:

a first lens surface having a concave shape which defines a space for housing the LED light source;

a second lens surface formed in a convex shape curving outward at a position opposite the first lens surface; and a third lens surface formed continuously from a rear edge portion of the second lens surface, the rear edge portion being on a side opposite an illumination target side, wherein:

the first lens surface includes a first light-entering surface through which a portion of the light from the LED light source enters, and a second light-entering surface through which another portion of the light from the LED light source enters, the second lens surface is a light-exiting surface which refracts at least a portion of the light which has entered the optical lens through the first light-entering surface, in a direction with a predetermined tilt relative to the optical axis, thereby causing the portion of the light to travel to the illumination target, the third lens surface is a total reflection surface which totally reflects, to the substrate, at least a portion of the light which has entered the optical lens through the second light-entering surface, and an angle between the third lens surface and a principal surface of the substrate on a virtual plane which includes the optical axis is smaller than an angle between the second light-entering surface and the principal surface of the substrate on the virtual plane, at any rotated position, when the virtual plane is rotated about the optical axis to cut the third lens surface.

* * * * *